US011541401B2

(12) United States Patent
Lee et al.

(10) Patent No.: US 11,541,401 B2
(45) Date of Patent: Jan. 3, 2023

(54) DUST COLLECTING TOWER APPARATUS

(71) Applicant: DOOSAN ENERBILITY CO., LTD., Changwon-si (KR)

(72) Inventors: Jin Woon Lee, Gimhae-si (KR); Sang Rin Lee, Changwon-si (KR); Jae Dong Hwang, Gunsan-si (KR); Sang Chul Moon, Seoul (KR)

(73) Assignee: DOSAN ENERBILITY CO., LTD., Changwon (KR)

( * ) Notice: Subject to any disclaimer, the term of this patent is extended or adjusted under 35 U.S.C. 154(b) by 314 days.

(21) Appl. No.: 16/855,942

(22) Filed: Apr. 22, 2020

(65) Prior Publication Data

US 2020/0368760 A1 Nov. 26, 2020

(30) Foreign Application Priority Data

May 20, 2019 (KR) ..... 10-2019-0059060

(51) Int. Cl.

| | |
|---|---|
| ***B03C 3/78*** | (2006.01) |
| ***B03C 3/41*** | (2006.01) |
| ***B03C 3/47*** | (2006.01) |
| ***B03C 3/66*** | (2006.01) |
| ***B03C 3/88*** | (2006.01) |
| ***B03C 3/82*** | (2006.01) |
| ***B03C 3/02*** | (2006.01) |
| ***G09F 9/33*** | (2006.01) |

(52) U.S. Cl.

CPC ..... *B03C 3/78* (2013.01); *B03C 3/02* (2013.01); *B03C 3/41* (2013.01); *B03C 3/47* (2013.01); *B03C 3/66* (2013.01); *B03C 3/82* (2013.01); *B03C 3/88* (2013.01); *G09F 9/33* (2013.01)

(58) Field of Classification Search

CPC combination set(s) only.
See application file for complete search history.

(56) References Cited

U.S. PATENT DOCUMENTS 3,511,030 A * 5/1970 Brown ..... B03C 3/66 96/25
3,891,414 A * 6/1975 Snader ..... B03C 3/88 96/28

(Continued)

FOREIGN PATENT DOCUMENTS

CN 2544810 Y 4/2003
CN 103691556 A * 4/2014

(Continued)

*Primary Examiner* — Christopher P Jones
*Assistant Examiner* — Sonji Turner
(74) *Attorney, Agent, or Firm* — Harvest IP Law LLP

(57) ABSTRACT

Disclosed herein is a dust collecting tower apparatus that includes a housing having an inlet, into which gas is introduced, and an outlet from which the gas is discharged, and a collection module disposed in the housing and configured to collect particulates with a corona discharge. The collection module includes a plurality of discharge electrodes, to which a voltage is applied, a plurality of collection electrodes disposed between the respective discharge electrodes, where the collection electrodes is grounded, and a first setting beam having a plurality of lower slots into which the discharge electrodes are inserted. The apparatus further includes a washing water feeder configured to spray washing water to the collection module.

16 Claims, 16 Drawing Sheets

(56) References Cited

U.S. PATENT DOCUMENTS

| | | | | | |
|---|---|---|---|---|---|
| 3,893,828 | A | * | 7/1975 | Archer | B03C 3/68 96/19 |
| 3,958,960 | A | * | 5/1976 | Bakke | B03C 3/16 96/232 |
| 4,360,366 | A | * | 11/1982 | Collins | B03C 3/53 96/45 |
| 5,421,863 | A | * | 6/1995 | Rector | B03C 3/12 96/60 |
| 5,573,102 | A | * | 11/1996 | Puchalla | B65G 45/12 198/497 |
| 11,229,916 | B2 | * | 1/2022 | Williamsson | B03C 3/68 |

FOREIGN PATENT DOCUMENTS

| | | | | |
|---|---|---|---|---|
| CN | 104129837 | A | | 11/2014 |
| CN | 205667905 | U | | 11/2016 |
| CN | 206104130 | U | | 4/2017 |
| CN | 107051730 | A | | 8/2017 |
| CN | 108348925 | A | | 7/2018 |
| CN | 108380386 | A | | 8/2018 |
| CN | 111947239 | A | | 11/2020 |
| JP | 11-047520 | A | | 2/1999 |
| JP | 2000107637 | A | * | 4/2000 |
| JP | 2009-095799 | A | | 5/2009 |
| JP | 2014-100642 | A | | 6/2014 |
| KR | 10-0818639 | B1 | | 4/2008 |
| KR | 10-2010-0121368 | A | | 11/2010 |
| KR | 10-2018-0080803 | A | | 7/2018 |

* cited by examiner

DUST COLLECTING TOWER APPARATUS

CROSS-REFERENCE TO RELATED APPLICATION

This application claims priority to Korean Patent Application No. 10-2019-0059060, filed on May 20, 2019 the disclosure of which is incorporated herein by reference in its entirety.

BACKGROUND

Technical Field

Exemplary embodiments relate to a dust collecting tower apparatus that collects dust in the air outdoors, such as in a downtown area.

Related Art

In order to create pleasant air in a living space and protect human health, the installation of air filters is continuously increasing. Due to the frequent occurrence of fine dust in recent years, the necessity of purifying air outdoors as well as indoors, such as in buildings or underground facilities, is growing.

In particular, fine dust from various pollution sources and neighboring countries frequently occurs in downtown areas in recent years. These contaminants are distributed in various particle sizes ranging from submicrons to several tens of microns, and have very different chemical or microbiological properties. Hence, the harmful effects of the contaminants on the human body vary depending on the chemical or microbiological properties of the contaminants.

Accordingly, it has been proposed to install dust collecting tower apparatus outdoors, especially in downtown areas. A conventional dust collecting tower apparatus uses a method of heating air so that the heated air rises and of purifying the rising air by means of filters so that the purified air is discharged. However, the method of purifying air using the filters may bring about a large pressure loss.

SUMMARY

Aspects of one or more exemplary embodiments provide a dust collecting tower apparatus capable of efficiently removing dust while minimizing a loss of pressure.

Additional aspects will be set forth in part in the description which follows and, in part, will become apparent from the description, or may be learned by practice of the exemplary embodiments.

According to an aspect of an exemplary embodiment, there is provided a dust collecting tower apparatus installed outdoors to collect fine dust contained in the air. The dust collecting tower apparatus includes a housing having an inlet, into which gas is introduced, and an outlet from which the gas is discharged, a collection module disposed in the housing and including a plurality of discharge electrodes, to which a voltage is applied, and a plurality of collection electrodes disposed between the respective discharge electrodes, the collection electrodes being grounded, the collection module being configured to collect particulates with a corona discharge, and a washing water feeder configured to spray washing water to the collection module, wherein the collection module includes a first setting beam having a plurality of lower slots into which the discharge electrodes are inserted.

A solar panel may be attached to an outer surface of the housing to produce electricity with light.

A display panel may be attached to an outer surface of the housing to display an atmospheric state.

The dust collecting tower apparatus may further include a washing water treatment device disposed beneath the collection module to accommodate the washing water dropping from the collection module. The washing water treatment device may include a reservoir configured to accommodate the washing water, an adsorption belt in an endless-track form, a roller connected to the adsorption belt to move the adsorption belt, and a scraper configured to scrape off dust attached on the adsorption belt to separate the scraped dust from the adsorption belt.

The adsorption belt may be in a mesh form.

A portion of the adsorption belt may be submerged in the washing water and the other portion of the adsorption belt may be positioned above the washing water.

The scraper may include a support rod installed vertically on the bottom of the reservoir and an elastic tip protruding upward from the support rod.

The scraper may include a rotational column and a plurality of separation ribs protruding from an outer peripheral surface of the column, the separation ribs being spaced apart from each other in a circumferential direction of the column.

The washing water treatment device may include two support rollers and first and second diversion rollers disposed between the support rollers, the first diversion roller being configured to support a lower end of the adsorption belt to move upward, the second division roller being configured to support the lower end of the adsorption belt to move downward. A blocking wall may be installed in the reservoir to separate a space, in which the scraper is present, from a remaining space. The first diversion roller may support the adsorption belt to be positioned above an upper end of the blocking wall, and the second diversion roller may support the adsorption belt to be positioned beneath the upper end of the blocking wall.

The scraper may abut on the adsorption belt between the second diversion roller and an associated one of the support rollers.

A separation container may be installed beneath the scraper and positioned in the space separated by the blocking wall.

The dust collecting tower apparatus may further include a frame assembly fixed in the housing to support the collection module. The frame assembly may include a lower frame extending in a stacking direction of the discharge electrodes to support the first setting beam, the lower frame being configured to apply a voltage to the discharge electrodes through the first setting beam.

The dust collecting tower apparatus may further include a frame assembly fixed in the housing to support the collection module. The frame assembly may include a prestress locking member fixed in the housing in a state in which a pressing force is applied to the collection module.

The prestress locking member may include a casing, an insulator installed in the casing, a pressure rod coupled to the insulator while protruding downward, and a pressing support fixed to the pressure rod to press the collection module.

The collection module may include first tie rods fixed to the discharge electrodes and installed to pass through the collection electrodes, second tie rods fixed to the collection electrodes and installed to pass through the discharge electrodes, and a plurality of upper support beams to which some of the first tie rods are fixed. The prestress locking member may be fixedly installed to press an associated one of the upper support beams inward.

The collection electrodes may have the lowest ends formed on respective lower surfaces thereof so that the washing water is concentrated on the lowest ends. A discharge guide may be installed immediately beneath the lowest ends and have a channel in which the washing water flowing down from the collection electrodes is accommodated. The discharge guide may extend in a stacking direction of the collection electrodes.

The collection electrodes may have fixing holes formed in respective lower portions thereof, and a hanger fixing rod may be inserted into the fixing holes. The hanger fixing rod may be coupled to a support hanger that supports the discharge guide. The support hanger may include a plurality of connection protrusions protruding upward and inserted into lower portions of the respective collection electrodes, and the connection protrusions may be respectively formed with support holes into which the hanger fixing rod is inserted.

According to an aspect of another exemplary embodiment, there is provided a dust collecting tower apparatus that includes a housing having an inlet, into which gas is introduced, and an outlet from which the gas is discharged, a collection module disposed in the housing and including a plurality of discharge electrodes, to which a voltage is applied, and a plurality of collection electrodes disposed between the respective discharge electrodes, the collection electrodes being grounded, the collection module being configured to collect particulates with a corona discharge, a washing water feeder configured to spray washing water to the collection module, and a washing water treatment device disposed beneath the collection module to scrape off dust attached on an adsorption belt to separate the scraped dust from the adsorption belt, the adsorption belt being installed in a reservoir configured to accommodate the washing water dropping from the collection module.

According to an aspect of a further exemplary embodiment, there is provided a dust collecting tower apparatus that includes a housing having an inlet, into which gas is introduced, and an outlet from which the gas is discharged, a collection module disposed in the housing and including a plurality of discharge electrodes, to which a voltage is applied, and a plurality of collection electrodes disposed between the respective discharge electrodes, the collection electrodes being grounded, the collection module being configured to collect particulates with a corona discharge, a washing water feeder configured to spray washing water to the collection module, and a frame assembly fixed in the housing to support the collection module, wherein the frame assembly may include a prestress locking member fixed in the housing in a state in which a pressing force is applied to the collection module.

The prestress locking member may include a casing, an insulator installed in the casing, a pressure rod coupled to the insulator while protruding downward, and a pressing support fixed to the pressure rod to press the collection module.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
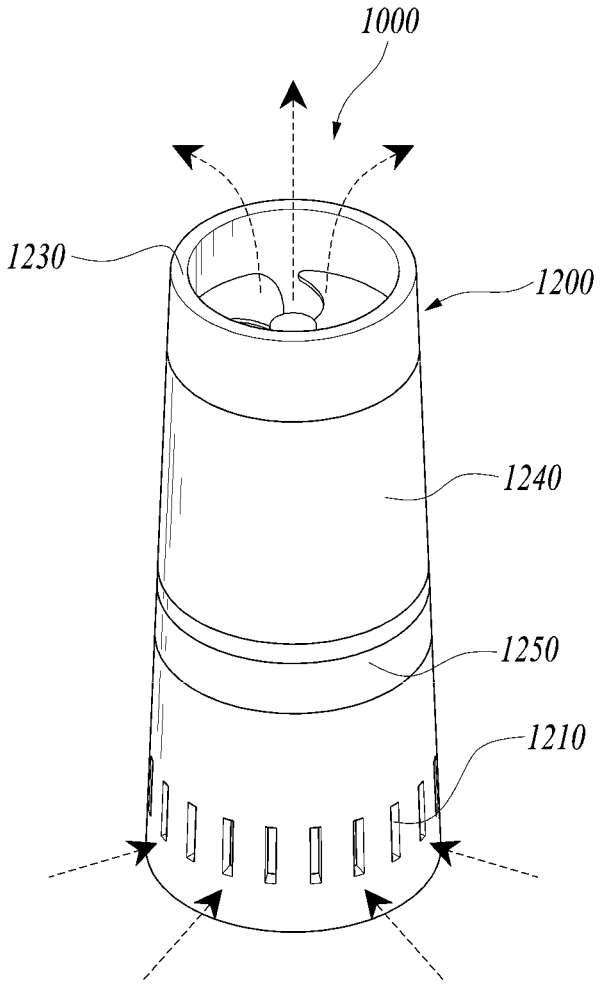
FIG. 1 is a perspective view illustrating a dust collecting tower apparatus according to a first exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. Throughout the disclosure, like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
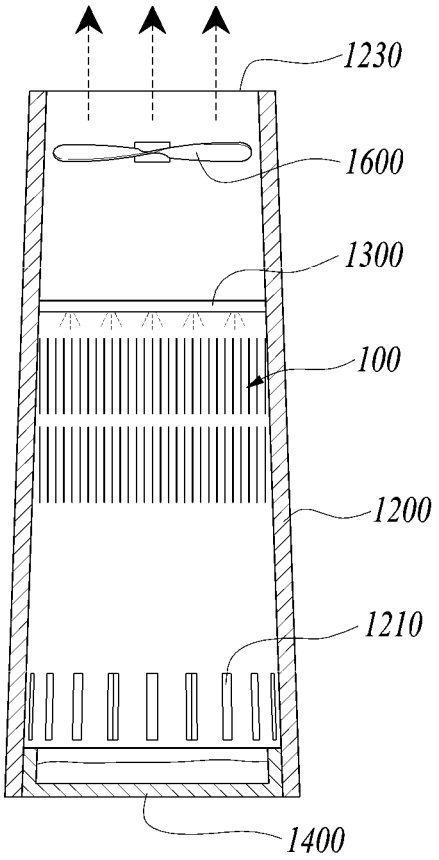
FIG. 2 is a longitudinal sectional view illustrating the dust collecting tower apparatus according to the first exemplary embodiment.

FIG. 1 is a perspective view illustrating a dust collecting tower apparatus 1000 according to a first exemplary embodiment. FIG. 2 is a longitudinal sectional view illustrating the dust collecting tower apparatus 1000 according to the first exemplary embodiment.

Referring to FIGS. 1 and 2, the dust collecting tower apparatus 1000 introduces outside air thereinto to remove dust contained in the air and discharges the dust-removed air. The dust collecting tower apparatus 1000 may be installed outdoors, especially in a downtown area.

The dust collecting tower apparatus 1000 includes a housing 1200, collection modules 100, a frame assembly 200, a washing water feeder 1300, and a blower 1600.

The housing 1200 may be of a cylindrical shape that has a space therein. The housing 1200 may be of a structure in which its cross-sectional area is reduced toward the top. The housing 1200 has a plurality of inlets 1210 formed at the lower portion thereof for introduction of air, and an outlet 1230 formed at the upper end thereof for discharge of the air. A reservoir 1400 may be installed in the lower portion of the housing 1200 to store washing water therein.

A plurality of solar panels 1240 may be installed on the outer surface of the housing 1200. The solar panels 1240 have a general structure that produces electricity with light, and supply driving power to the dust collecting tower apparatus 1000. The solar panels 1240 may be installed in the circumferential direction of the housing 1200. In addition, a display panel 1250 may be attached to the outer surface of the housing 1200 and may be formed of LEDs or the like. The display panel 1250 may extend in the circumferential direction or the vertical direction of the housing 1200. The display panel 1250 may display an atmospheric state, such as humidity and fine dust concentration, as well as an advertisement.

The blower 1600 is disposed at the upper portion of the housing 1200. The blower 1600 moves air from bottom to top, and forms a flow of air so that the air is introduced from the inlets 1210 and discharged to the outlet 1230. The blower 1600 may consist of one or more blowers 1600, and the blowers 1600 may be installed above and below in the housing 1200.

The washing water feeder 1300 is disposed above the collection modules 100 to spray washing water toward the collection modules 100. The washing water feeder 1300 may be provided with a nozzle and a washing water supply line extending in the stacking direction of discharge electrodes 12 and collection electrodes 13. The washing water feeder 1300 may operate intermittently, for example, for a few minutes every few hours. When washing water is supplied, no voltage is applied to the discharge electrodes 12.

Figure 3:
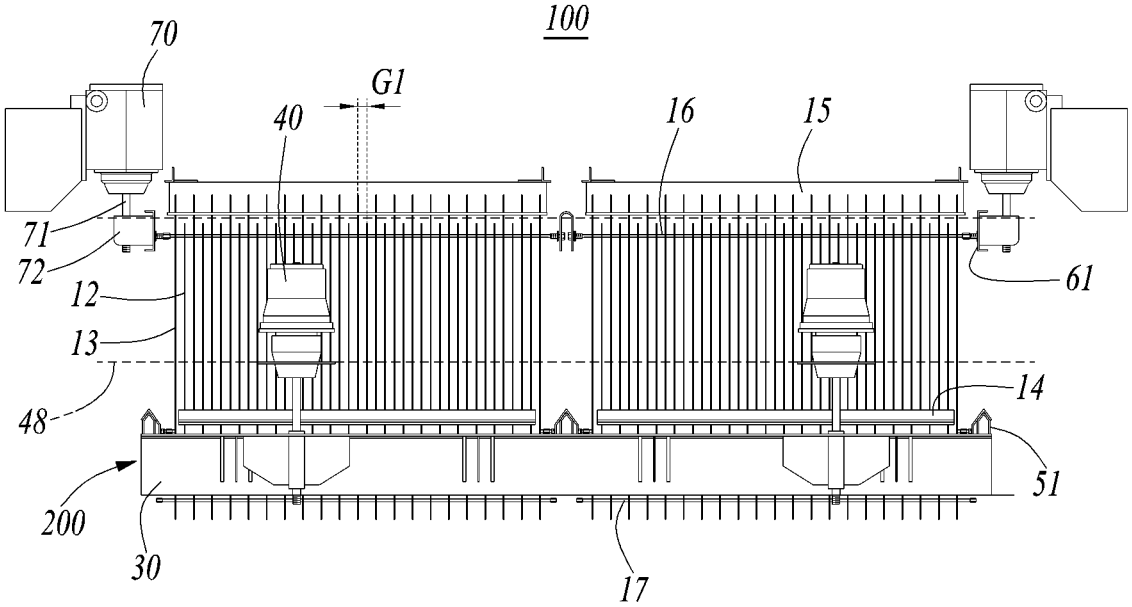
FIG. 3 is a side view illustrating a collection module and a frame assembly according to the first exemplary embodiment.
Figure 4:
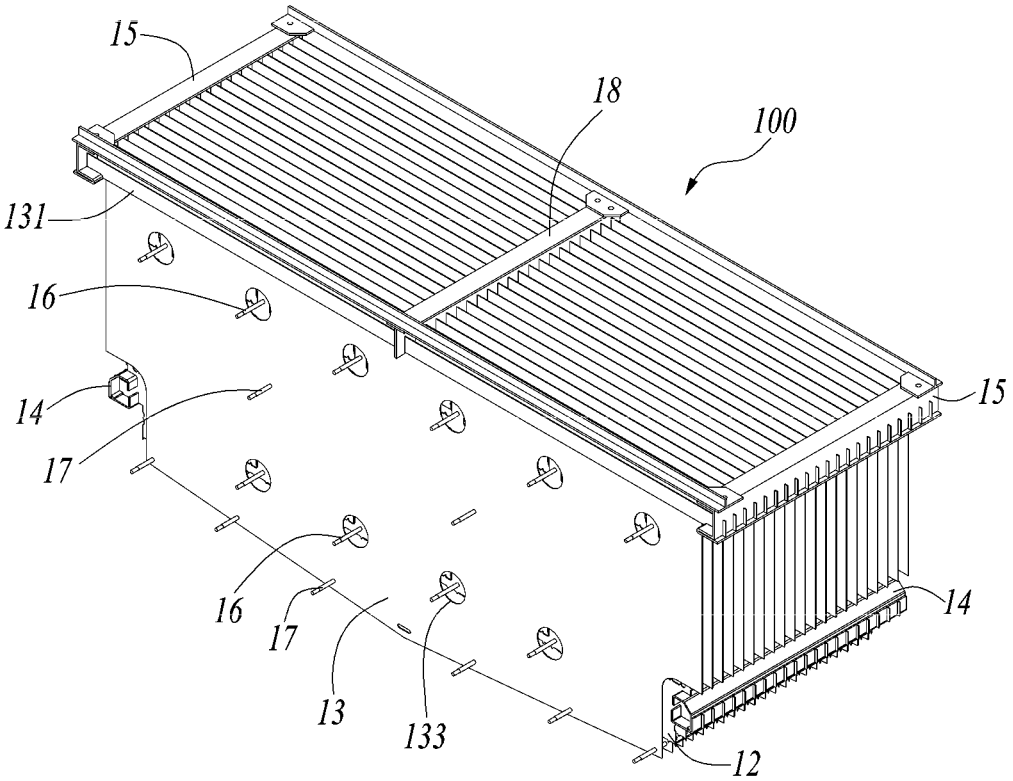
FIG. 4 is a perspective view illustrating one collection module according to the first exemplary embodiment.
Figure 5:
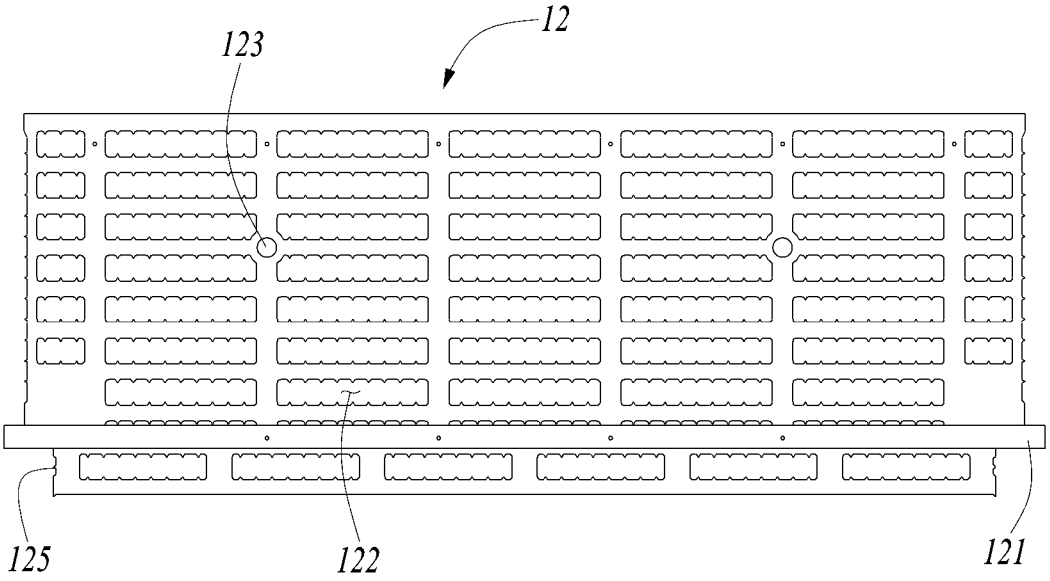
FIG. 5 is a front view illustrating one discharge electrode according to the first exemplary embodiment.
Figure 6:
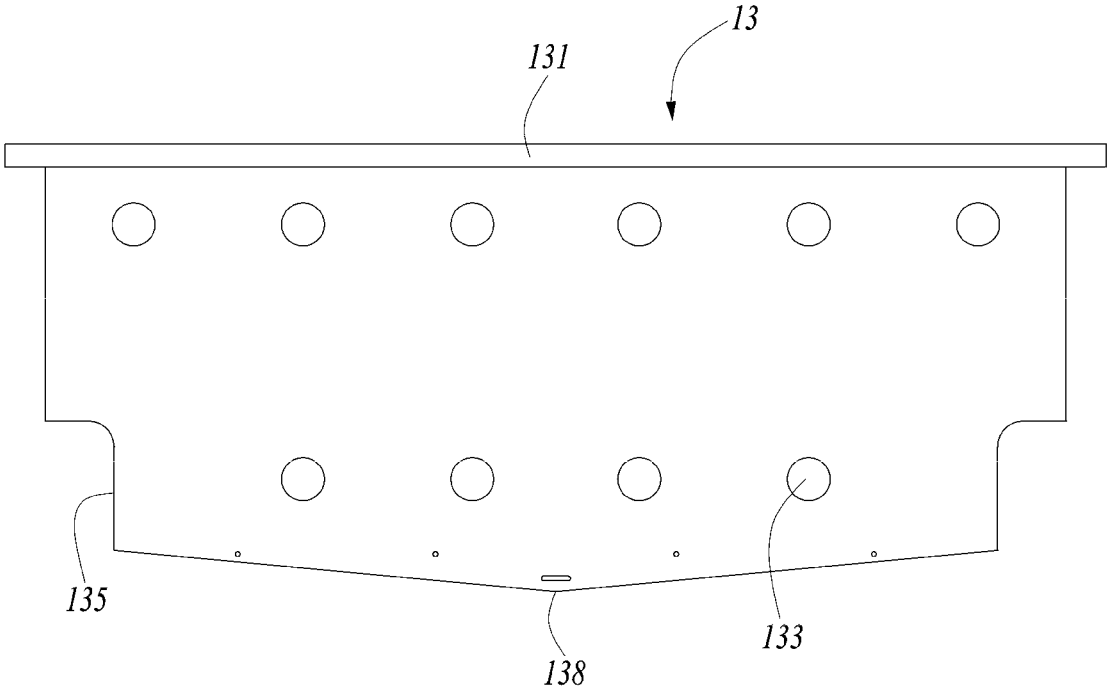
FIG. 6 is a front view illustrating one collection electrode according to the first exemplary embodiment.

FIG. 3 is a side view illustrating the collection modules 100 and the frame assembly 200 according to the first exemplary embodiment. FIG. 4 is a perspective view illustrating one collection module according to the first exemplary embodiment. FIG. 5 is a front view illustrating one discharge electrode according to the first exemplary embodiment. FIG. 6 is a front view illustrating one collection electrode according to the first exemplary embodiment.

Referring to FIGS. 3 to 6, each of the collection modules 100 includes discharge electrodes 12, collection electrodes 13, first tie rods 16, second tie rods 17, first setting beams 14, second setting beams 15, and a central setting beam 18. The collection module 100 may be installed inside the housing 1200 through the frame assembly 200 in the state in which the collection module 100 is fixed by the first tie rods 16 and the second tie rods 17 and the first setting beams 14, the second setting beams 15, and the central setting beam 18. The frame assembly 200 is fixed to the inner wall of the housing 1200 to support the collection module 100.

Each of the discharge electrodes 12 has a flat plate shape and has a plurality of openings 122. Each of the openings 122 may be of a square shape, and the discharge electrodes 12 have a plurality of discharge pins formed at their edges. Each of the discharge pins may be in a needle form and may be spaced apart from each other along the outer end and the openings 122 of the discharge electrode 12.

The discharge electrode 12 includes a first reinforcement rod 121 installed at the lower portion thereof, and the first reinforcement rod 121 is coupled to the first setting beams 14 to support the discharge electrode 12. The first reinforcement rod 121 is longer than the width of the discharge electrode 12 so as to protrude from both side ends of the discharge electrode 12. In addition, the discharge electrode 12 may have a plurality of first holes 123 through which the second tie rods 17 pass.

The discharge electrode 12 has cut grooves 125 formed on both lower portions thereof for installation of the first setting beams 14. The first reinforcement rod 121 together with the upper ends of the cut grooves 125 are inserted into and fixed by the first setting beams 14.

Each of the collection electrodes 13 is formed of a flat plate and has a plurality of second holes 133 through which the first tie rods 16 pass. The collection electrode 13 includes a second reinforcement rod 131 disposed at the upper portion thereof to support the collection electrode 13. The second reinforcement rod 131 is longer than the width of the collection electrode 13 so as to protrude from both side ends of the collection electrode 13.

The plurality of discharge electrodes 12 and collection electrodes 13 are arranged in parallel to each other, and the discharge electrodes 12 are equally disposed between the respective collection electrodes 13. A gap G1 between each of the collection electrodes 13 and the discharge electrode 12 adjacent thereto may be 50 to 70 mm in size.

The collection electrode 13 has avoidance grooves 135 formed on both side ends of the lower portion thereof, and the first setting beams 14 are installed to pass through portions where the avoidance grooves 135 are formed. The upper ends of the avoidance grooves 135 may be formed above the associated first reinforcement rod to prevent short circuit of the collection electrode 13 to the discharge electrode 12.

When a high voltage is applied to the discharge electrode 12, a corona discharge occurs between the discharge electrode 12 and the collection electrode 13 to generate an electrostatic force. Particulates are charged by combining with ions (electrons) generated with the corona discharge while gas moves to the region where the electrostatic force is generated with the corona discharge, and then attached on the collection electrode 13 by the electrostatic force. In addition, the ozone generated with the corona discharge may remove bacteria contained in the air.

Meanwhile, the collection electrode 13 may have a lower end inclined relative to the ground, and have a lowest end 138 of the inclined lower end. The lowest end 138 may be at the center of the collection electrode 13 or at one widthwise side of the collection electrode 13.

The lower end of the collection electrode 13 is inclined downward toward the widthwise center thereof from both side ends while being inclined relative to the ground. Thus, the central portion of the collection electrode 13 is positioned lower than both side ends thereof so that the washing water flowing along the surface of the collection electrode 13 is collected at the lowest end 138 of the central portion of the collection electrode 13 along the lower end of the collection electrode 13.

Each of the first tie rods 16 is fitted to the plurality of discharge electrodes 12 through the associated second holes 133 formed in the collection electrodes 13, in which case the first tie rods 16 do not come into contact with the collection electrodes 13. Some of the first tie rods 16 are coupled to the upper portion of each discharge electrode 12 and the other ones of the first tie rods 16 are coupled to the lower portion of each discharge electrode 12.

Each of the first tie rods 16 may have threads formed on the longitudinal ends thereof. Lower ones of the first tie rods 16 are fixed to lower support beams 51 and upper ones of the first tie rods 16 are fixed to upper support beams 61.

On the other hand, each of the second tie rods 17 is fitted to the plurality of collection electrodes 13 through the associated first holes 123 formed in the discharge electrodes 12, in which case the second tie rods 17 do not come into contact with the discharge electrodes 12.

Some of the second tie rods 17 are coupled to the upper portion of each collection electrode 13 and the other ones of the second tie rods 17 are coupled to the lower portion of each collection electrode 13. The longitudinal ends of each second tie rod 17 may be fixed to the associated collection electrodes 13, but the present disclosure is not limited thereto. For example, the second tie rods 17 may be fixed to other members within the housing 1200.

The first tie rods 116 and the second tie rods 17 may have spacers installed to maintain the distance between the discharge electrodes 12 and the collection electrodes 13. That is, the spacer installed on the first tie rod 16 may pass through an associated second hole 133 of each collection electrode 13 so that both longitudinal ends of the spacer abut on the facing surfaces of the discharge electrodes 12 adjacent to the collection electrode 13. In addition, the spacer installed on the second tie rod 17 may pass through an associated first hole 123 of each discharge electrode 12 so that both longitudinal ends of the spacer abut on the facing surfaces of the collection electrodes 13 adjacent to the discharge electrode 12.

Figure 7:
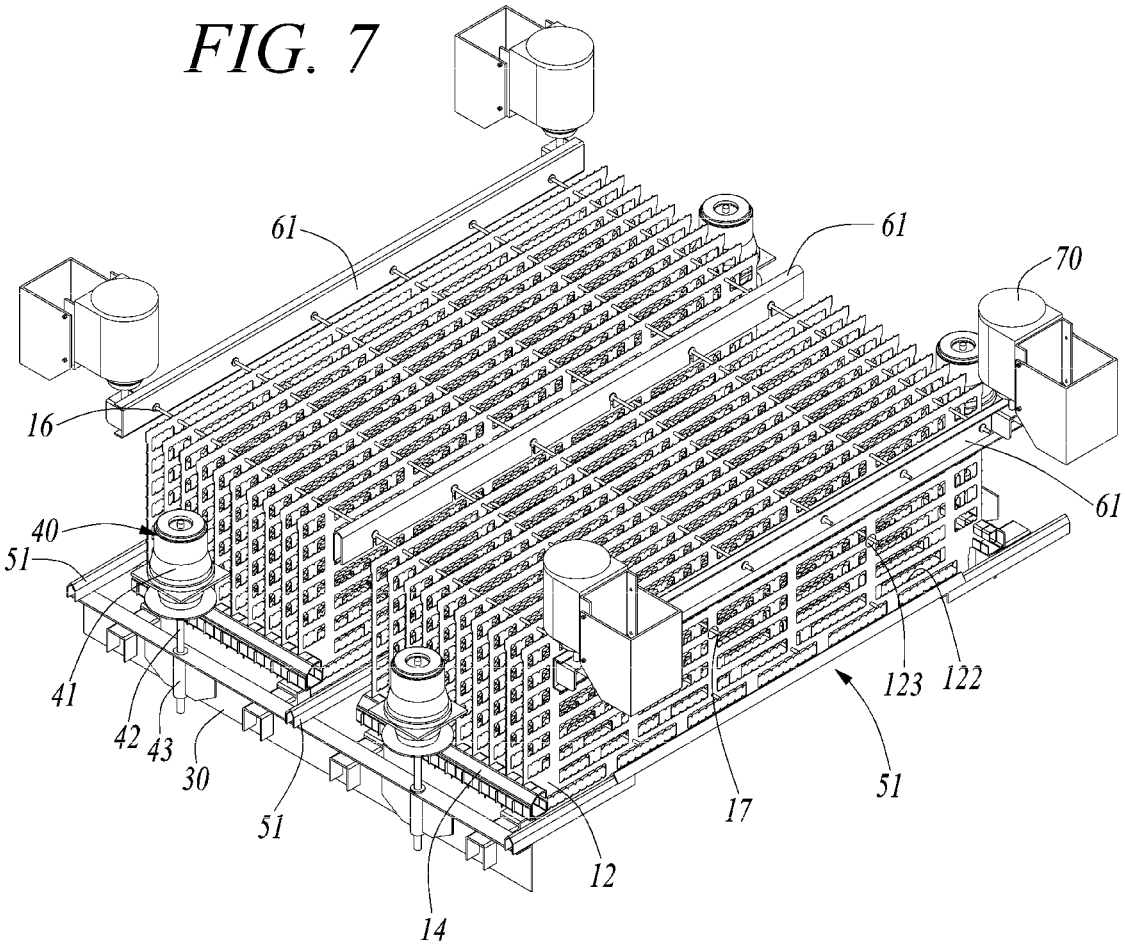
FIG. 7 is a perspective view illustrating the discharge electrodes and supports in the collection module, and the frame assembly according to the first exemplary embodiment.
Figure 8:
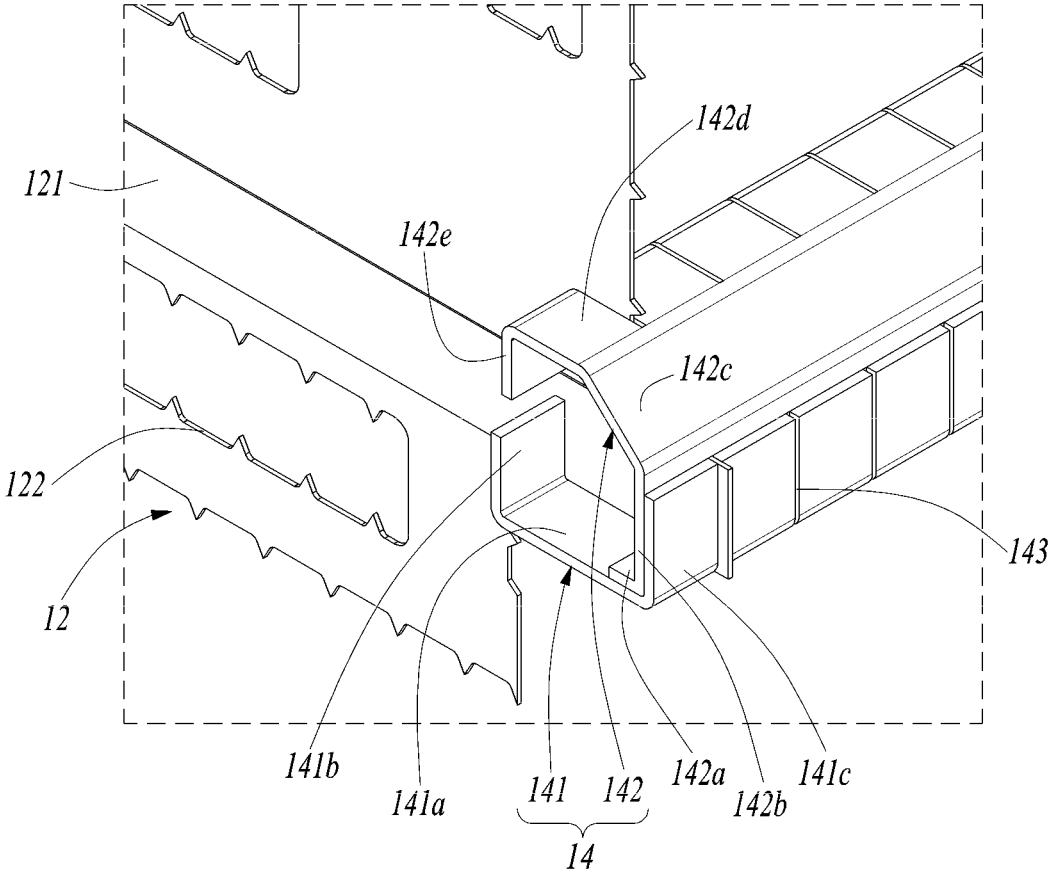
FIG. 8 is a view illustrating a state in which the discharge electrode is supported by one first setting beam according to the first exemplary embodiment.
Figure 9:
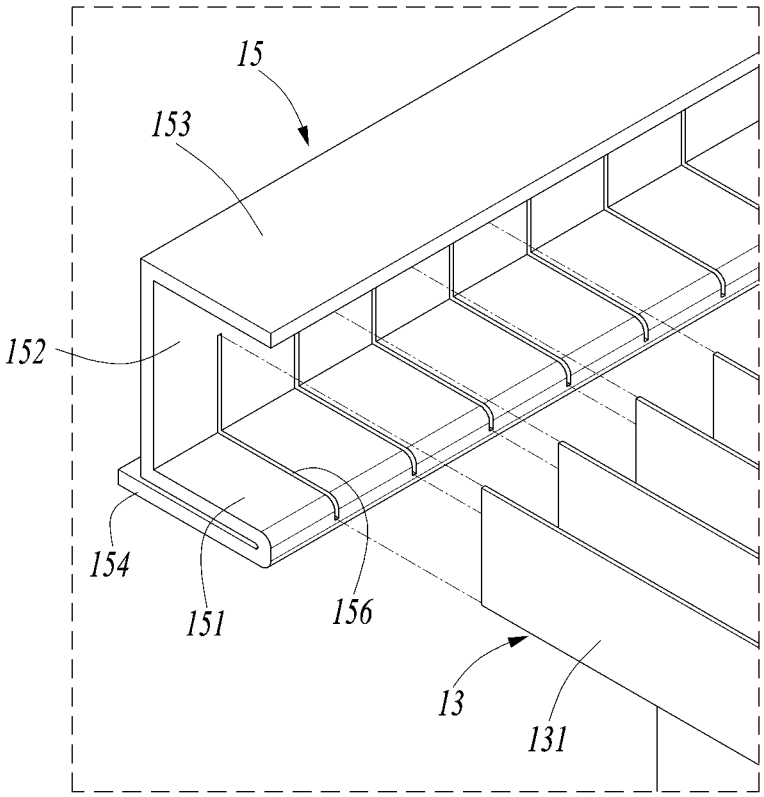
FIG. 9 is an exploded perspective view partially illustrating one second setting beam and collection electrodes according to the first exemplary embodiment.

FIG. 7 is a perspective view illustrating the discharge electrodes 12 and supports in the collection module 100, and the frame assembly 200 according to the first exemplary embodiment. FIG. 8 is a view illustrating a state in which the discharge electrode 12 is supported by one first setting beam 14 according to the first exemplary embodiment. FIG. 9 is an exploded perspective view partially illustrating one second setting beam 15 and the collection electrodes 13 according to the first exemplary embodiment.

Referring to FIGS. 7 to 9, each of the first setting beams 14 extends in the stacking direction of the discharge electrodes 12, and has a plurality of lower slots 143 into which the side ends of the respective discharge electrodes 12 are inserted. The first reinforcement rod 121 of each discharge electrode 12 is inserted into the first setting beam 14. The first reinforcement rod 121 is installed to pass through the first setting beam 14, and the lower end of the first reinforcement rod 121 is supported by the bottom of the first setting beam 14.

The first setting beam 14 may include a lower beam 141 and an upper beam 142 coupled to the lower beam 141. The lower beam 141 includes a bottom 141*a* and two sidewalls 141*b* and 141*c* bent and protruding upward from both side ends of the bottom 141*a*. The upper beam 142 includes a lower support 142*a* abutting on the bottom 141*a*, an outer support 142*b* bent from the lower support 142*a* and abutting on an outer one 141*c* of the sidewalls, an inclined support 142*c* bent obliquely upward from the outer support 142*b*, an upper support 142*d* bent from the inclined support 142*c* and disposed in parallel to the bottom 141*a*, and an inner support 142*e* bent and extending downward from the upper support 142*d*. The moisture remaining on the first setting beam 14 may be easily discharged to the outside through the inclined support 142*c*.

The lower slots 143 are formed only on the sidewalls 141*b* and 141*c* and are not formed on the bottom 141*a*. In addition, the lower slots 143 are also formed on the upper beam 142, namely, on the lower support 142*a* and the outer support 142*b*. Individual ones of the lower slots 143 formed on the lower beam 141 are connected to associated ones of the lower slots 143 formed on the upper beam 142. Each first reinforcement rod 121 protrudes through the associated lower slots 143 formed on the sidewalls 141*b* and 141*c* and the associated lower slot 143 formed on the outer support 142*b*.

When the upper beam 142 and the lower beam 141 are coupled to each other, the first setting beam 14 is of a tubular shape with one of its sides cut off. When the first setting beam 14 is separated into the upper beam 142 and the lower beam 141 as described above, the discharge electrode 12 may be easily welded to the lower beam 141. That is, when, after the discharge electrode 12 is welded to the lower beam 141, the upper beam 142 is coupled to the lower beam 141 and the discharge electrode 12 is welded to the upper beam 142, the discharge electrode 12 may be stably fixed to the first setting beam 14 while the first setting beam 14 is formed in a tubular shape.

The first reinforcement rod 121 may be made of the same material as the first setting beam 14 and may be thicker than the discharge electrode 12. Thus, the first reinforcement rod 121 may be easily welded to the first setting beam 14. The discharge electrode 12 should have a small thickness and an excellent electrical conductivity, in which case it may be difficult to weld the discharge electrode if the discharge electrode 12 is high in conductivity and thin in thickness. However, according to the first exemplary embodiment, the discharge electrode 12 can be easily welded to the first setting beam 14 since the discharge electrode 12 includes the first reinforcement rod 121.

Each of the second setting beams 15 extends in the stacking direction of the collection electrodes 13, and has a plurality of upper slots 156 into which the side ends of the respective collection electrodes 13 are inserted. The upper slots 156 may be spaced apart from each other in the longitudinal direction of the second setting beam 15, and the second setting beam 15 may be positioned above the first setting beam 14. Meanwhile, as illustrated in FIG. 4, a central setting beam 18 is installed on the upper widthwise centers of the collection electrodes 13, and has a plurality of "T"-shaped slots into which the upper centers of the respective collection electrodes 13 are inserted.

The second reinforcement rod 131 is fixed to the upper end of each collection electrode 13, and is inserted into the second setting beam 15. The second reinforcement rod 131 is installed to pass through the second setting beam 15, and the lower end of the second reinforcement rod 131 is supported by the second setting beam 15.

The second setting beam 15 includes a lower plate 151, a side plate 152 bent and extending upward from the lower plate 151, an upper plate 153 bent from the side plate 152 to face the lower plate 151, and a support plate 154 disposed beneath the lower plate 151. The second reinforcement rod 131 is partially inserted into the lower plate 151 and the side plate 152, and the lower end of the second reinforcement rod 131 abuts on the upper surface of the support plate 154. The second reinforcement rod 131 may be fixed to the second setting beam 15 by welding.

As described above, in the collection module 100 according to the first exemplary embodiment, the first tie rods 16 and the second tie rods, the first setting beams 14 and the second setting beams 15, and the central setting beam 18 may stably fix the discharge electrodes 12 and the collection electrodes 13 while maintaining the distance therebetween.

Figure 10:
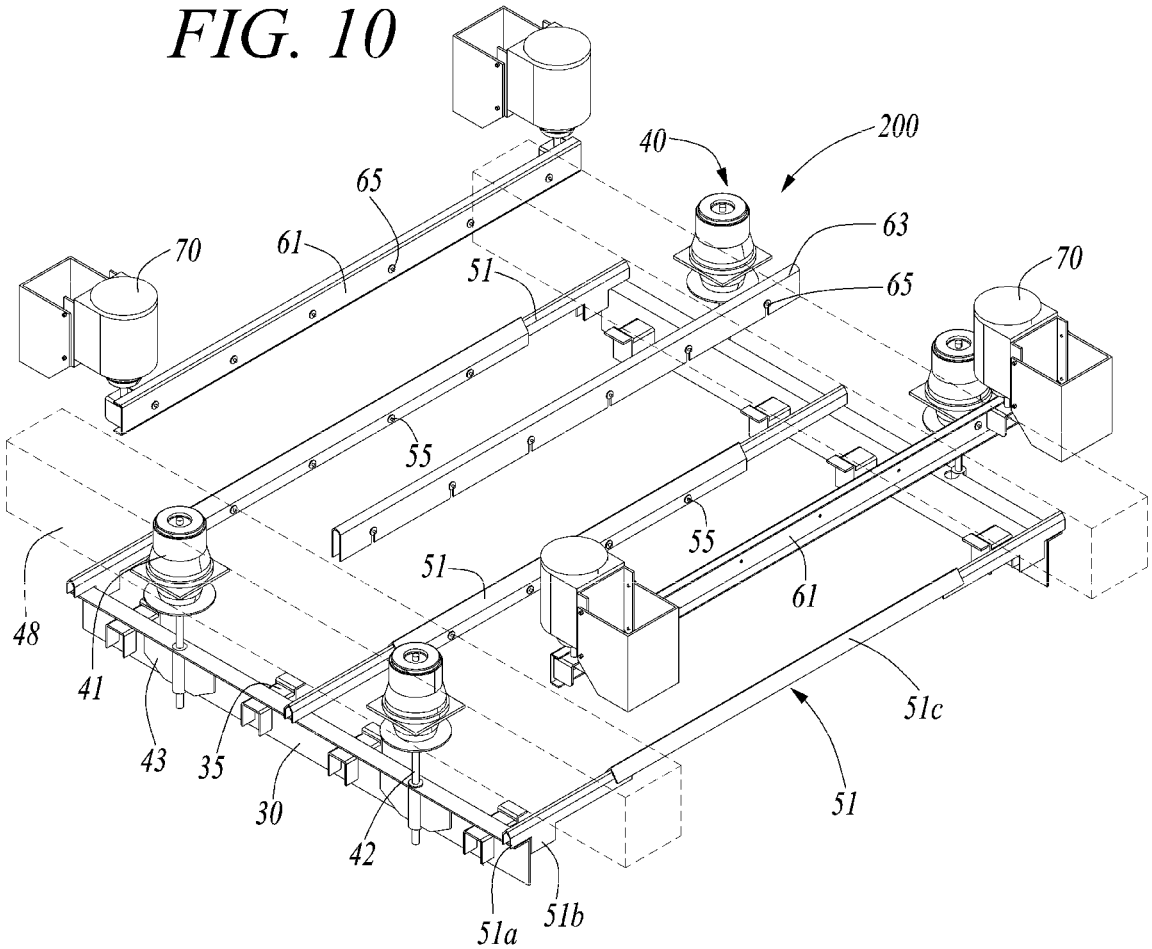
FIG. 10 is a perspective view illustrating the frame assembly according to the first exemplary embodiment.
Figure 11:
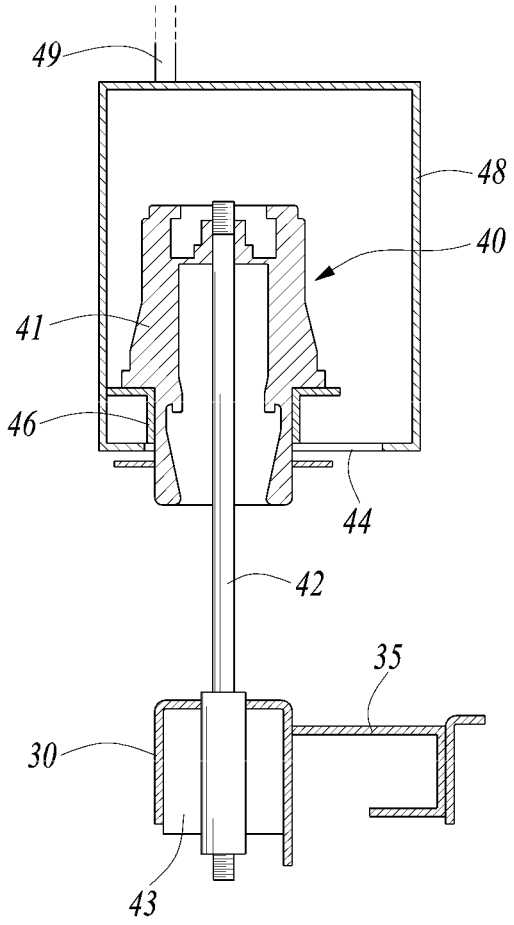
FIG. 11 is a cross-sectional view illustrating one insulating connection member and one lower frame according to the first exemplary embodiment.

FIG. 10 is a perspective view illustrating the frame assembly according to the first exemplary embodiment. FIG. 11 is a cross-sectional view illustrating one insulating connection member and one lower frame according to the first exemplary embodiment.

Referring to FIGS. 10 and 11, the frame assembly 200 includes lower frames 30, tubular girders 48, outer upper support beams 61, lower support beams 51, prestress locking members 70, and insulating connection members 40.

Each of the lower frames 30 extends in the stacking direction of the discharge and collection electrodes 12 and 13, and is supported by the insulating connection members 40. Two lower frames 30 are disposed in parallel to each other, and two insulating connection members 40 are installed to each of the lower frames 30. The lower frame 30 has a plurality of mounts 35 protruding laterally therefrom, and the associated first setting beam 14 is mounted on the mounts 35. The lower frame 30 is charged to a high voltage, and the first setting beam 14 and the discharge electrode 12 are also charged to a high voltage through the lower frame 30. Here, the charging voltage of the discharge electrode 12 may be 25,000 to 75,000 V.

The lower support beams 51 extend between the two lower frames 30 and are mounted on the lower frames 30. The lower support beams 51 are disposed at the outsides of the collection modules 100 and at the center between the collection modules 100, respectively. Each of the lower support beams 51 includes side protrusions 51*a* positioned on the lower frames 30, lower protrusions 51*b* protruding downward to abut on the sides of the lower frames 30, and a support bar 51*c* to which the first tie rods 16 are fixed.

The lower support beam 51 is provided with a plurality of connectors 55 to which the first tie rods 16 are coupled, and the connectors 55 are screwed with the first tie rods 16 to fix the first tie rods 16. One longitudinal end of each first tie rod 16 is fixed to an associated one of the outer lower support beams 51 and the other longitudinal end thereof is fixed to the central lower support beam 51.

As described above, according to the first exemplary embodiment, the collection module 100 can be easily fixed to the frame assembly 200 by fastening the first tie rods 16 to the lower support beams.

Meanwhile, the insulating connection members 40 are installed to the lower frames 30. Each of the insulating connection members 40 includes a terminal rod 42 configured to apply a high voltage to the discharge electrode 12, and a lower insulator 41 for insulation. The insulating connection member 40 may have a hole formed in the lower portion thereof for downward injection of air, and the terminal rod 42 is fixed to the associated lower frame 30 by protruding downward through the hole. An anchor 43 is installed to the terminal rod 42 to support the lower frame 30.

Thus, a high voltage is applied to the discharge electrode 12 through the lower frame 30 and the first setting beam 14. In addition, the lower frame 30 is suspended from the insulating connection member 40.

The insulating connection members 40 are inserted into the tubular girders 48 each having an internal space, and the tubular girders 48 extend in the same direction as the lower frames 30. The tubular girders 48 may be fixed to the inner wall of the housing 1200, and a purge air supply pipe 49 may be installed on each of the tubular girders 48. The tubular girder 48 may have a discharge hole 44 formed in the lower portion thereof for discharge of purge air.

The tubular girder 48 has a mount 46 installed therein to support the lower insulator 41, and the lower insulator 41 is placed on the mount 46. A power supply is connected to the insulating connection member 40 to apply a high voltage thereto, and the terminal rod 42 is insulated and fixed to the tubular girder 48 through the lower insulator 41. The terminal rod 42 may pass through the center of the lower insulator 41, and a power supply line may be connected to the upper end of the terminal rod 42. Thus, the terminal rod 42 may be charged to a high voltage and the tubular girder 48 may be grounded.

The second setting beam 15 may be fixed on the upper surface of the tubular girder 48 and the lower end of the second setting beam 15 may be fixed to the tubular girder 48 by welding or the like. The second setting beam 15 extends in the same direction as the longitudinal direction of the tubular girder 48.

Figure 12:
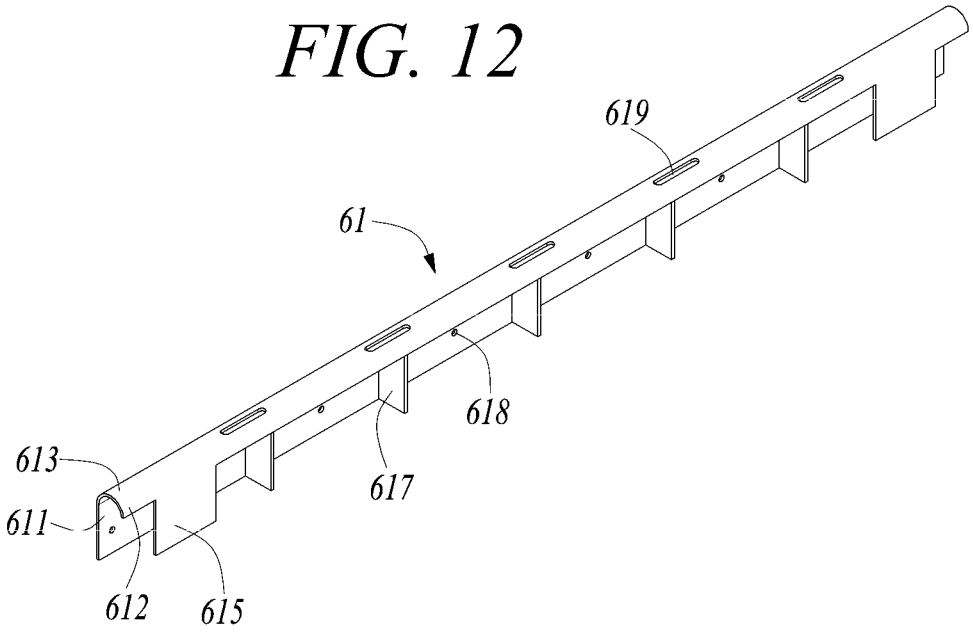
FIG. 12 is a perspective view illustrating one outer upper support beam according to the first exemplary embodiment.
Figure 13:
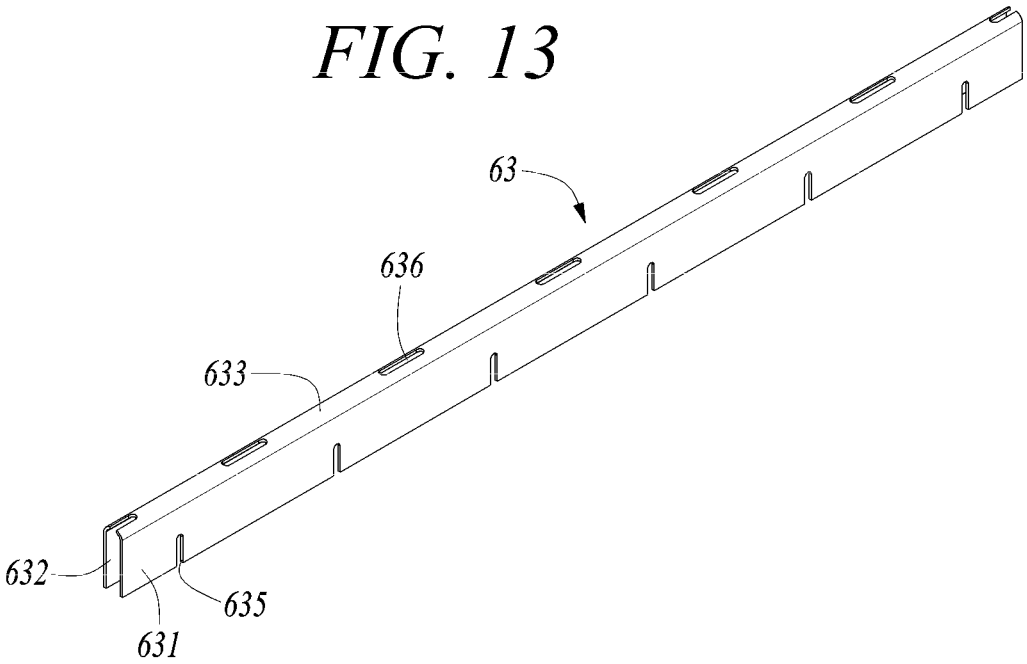
FIG. 13 is a perspective view illustrating a central upper support beam according to the first exemplary embodiment.

FIG. 12 is a perspective view illustrating an outer upper support beam 61 according to the first exemplary embodiment. FIG. 13 is a perspective view illustrating a central upper support beam 63 according to the first exemplary embodiment.

Referring to FIGS. 12 and 13, the outer upper support beams 61 are disposed above the collection modules 100 and are disposed on both outer sides of the collection modules 100, respectively. The central upper support beam 63 is disposed between the outer upper support beams 61 and at the upper center between the collection modules 100.

Each of the outer upper support beams 61 and the central upper support beam 63 is provided with a plurality of connectors 65 (see FIG. 10) to which the first tie rods 16 are coupled, and the connectors 65 are screwed with the first tie rods 16 to fix the first tie rods 16. One longitudinal end of each first tie rod 16 is fixed to an associated one of the outer upper support beams 61 and the other longitudinal end thereof is fixed to the central upper support beam 63.

Each of the outer upper support beams 61 includes a front plate 611 and a back plate 612 facing each other, and a support plate 613 connecting the front plate 611 to the back plate 612. The front plate 611 and the back plate 612 may each be a flat plate and the support plate 613 may be a curved plate. The support plate 613 has a plurality of holes 619 formed for discharge of washing water. The front plate 611 may have holes 618 formed for coupling with the connectors.

The back plate 612 has a height smaller than the front plate 611, and coupling plates 615 protrude downward from the back plate 612 so that the prestress locking members 70 are coupled to the coupling plates 615. The coupling plates 615 are positioned at both longitudinal edges of the outer upper support beam 61.

The outer upper support beam 61 further includes reinforcement ribs 617, which are positioned between the front plate 611 and the back plate 612 and abut on and support the inner surfaces of the front plate 611 and the back plate 612. The reinforcement ribs 617 are spaced apart from each other in the longitudinal direction of the outer upper support beam 61.

Meanwhile, the central upper support beam 63 includes two wall surfaces 631 and 632 extending downward, and a support surface 633 which connects the wall surfaces 631 and 632 and is curved. The wall surfaces 631 and 632 may each have a plurality of grooves 635 into which the connectors 65 are inserted, and the support surface 633 may have a plurality of holes 636 formed for discharge of washing water.

The prestress rocking members 70 are connected to the outer upper support beam 61 to press and support the outer upper support beam 61. In order to reduce the vibration of the collection module 100, the prestress locking members 70 are fixedly installed in the state in which a pressing force is applied to the outer upper support beam 61 to press the outer upper support beam 61 inward.

Figure 14:
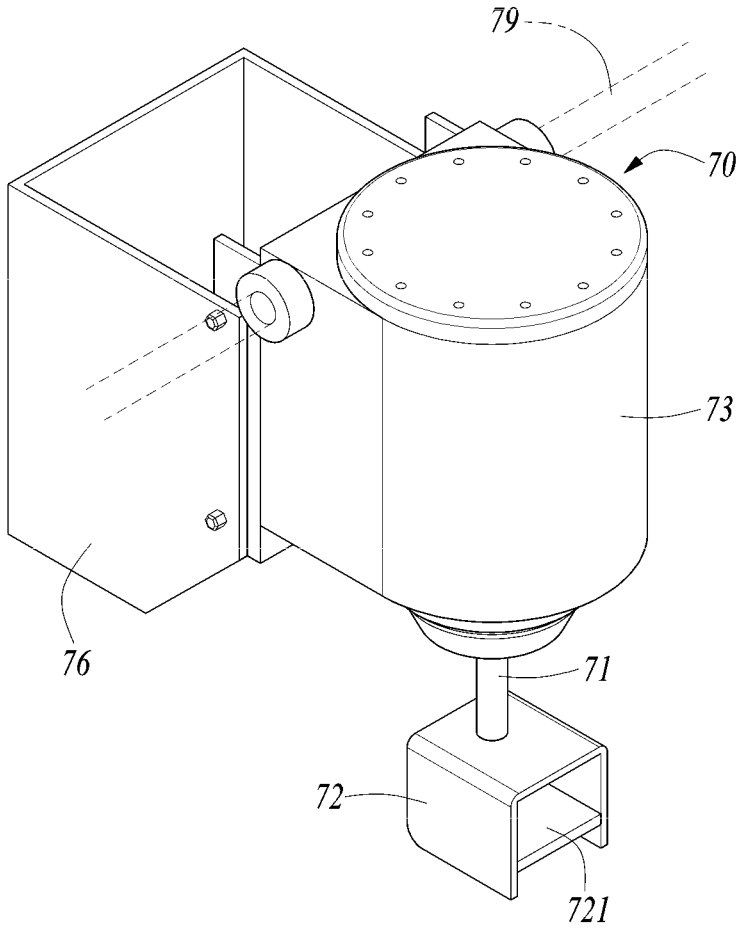
FIG. 14 is a perspective view illustrating one prestress locking member according to the first exemplary embodiment.
Figure 15:
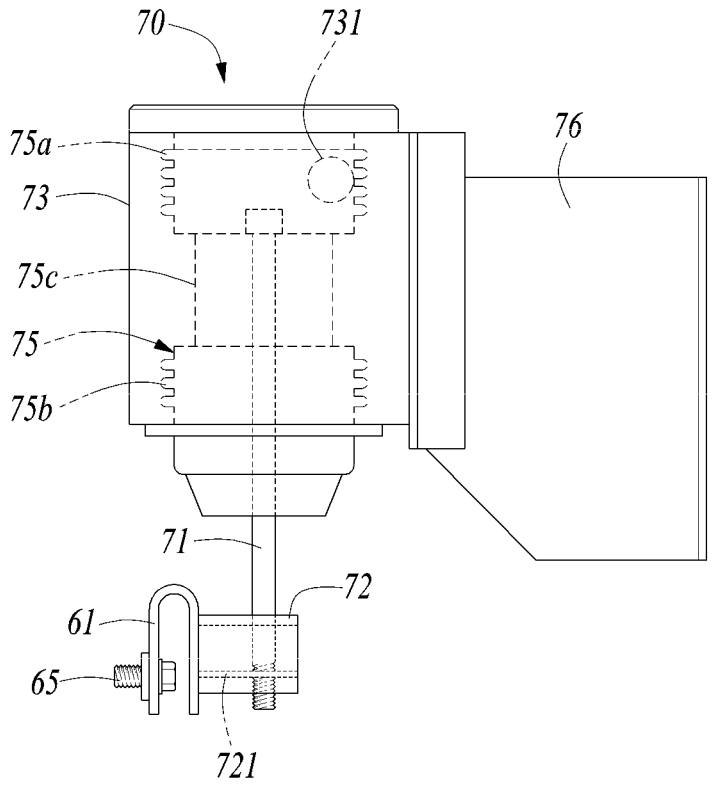
FIG. 15 is a side view illustrating the prestress locking member according to the first exemplary embodiment.

FIG. 14 is a perspective view illustrating the prestress locking member 70 according to the first exemplary embodiment. FIG. 15 is a side view illustrating the prestress locking member 70 according to the first exemplary embodiment.

Referring to FIGS. 14 and 15, each of the prestress locking members 70 is fixed to the inner wall of the housing 1200, and includes a casing 73, an insulator 75 installed in the casing 73, a pressure rod 71 coupled to the insulator 75, and a pressing support 72 coupled to the pressure rod 71.

The casing 73 is cylindrical and has an internal space, and a bracket 76 is installed to one side of the casing 73 to fix the casing 73 to the housing 1200. The casing 73 may be provided with an air inlet 731, and a purge air supply pipe 79 may be connected to the air inlet 731. The purge air introduced into the casing 73 prevents a short circuit due to moisture while the purge air is being discharged downward.

The insulator 75 may include an upper insulator 75*a* fixed to the upper portion of the casing 73, a lower insulator 75*b* fixed to the lower portion of the casing 73, and an insulating tube 75*c* connecting the upper insulator 75*a* and the lower insulator 75*b*. The pressure rod 71 is fixed to the insulator 75 and protrudes downward of the prestress locking member 70. The pressure rod 71 has a thread formed on the lower portion thereof for fastening with the pressing support 72.

The pressing support 72 is fixed to the lower portion of the pressure rod 71 and includes an inner support plate 721 to fixate with the pressure rod 71. The inner support plate 721 is screwed to the pressure rod 71. The pressing support 72 abuts on the outer upper support beam 61 to press the outer upper support beam 61 into the collection module 100.

When the outer upper support beam 61 is installed in the state in which it is pressured by the prestress locking member 70 as in the first exemplary embodiment, it may be possible to effectively reduce the vibration of the collection module 100. In addition, since the collection module 100 is installed inside the dust collecting tower apparatus 1000, it may be possible to efficiently purify air pollution in the downtown area or the like by removing fine dust while minimizing a loss of pressure.

Hereinafter, a dust collecting tower apparatus according to a second exemplary embodiment will be described.

Figure 16:
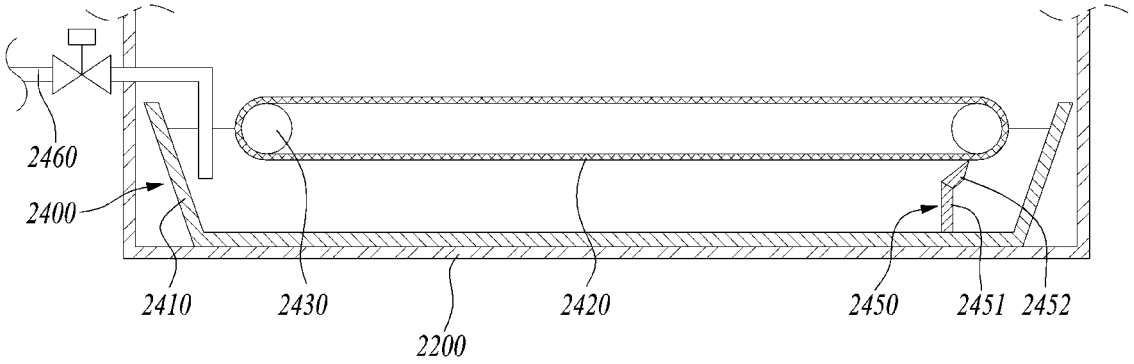
FIG. 16 is a cross-sectional view illustrating a washing water treatment device disposed in a lower portion of a dust collecting tower apparatus according to a second exemplary embodiment.
Figure 17:
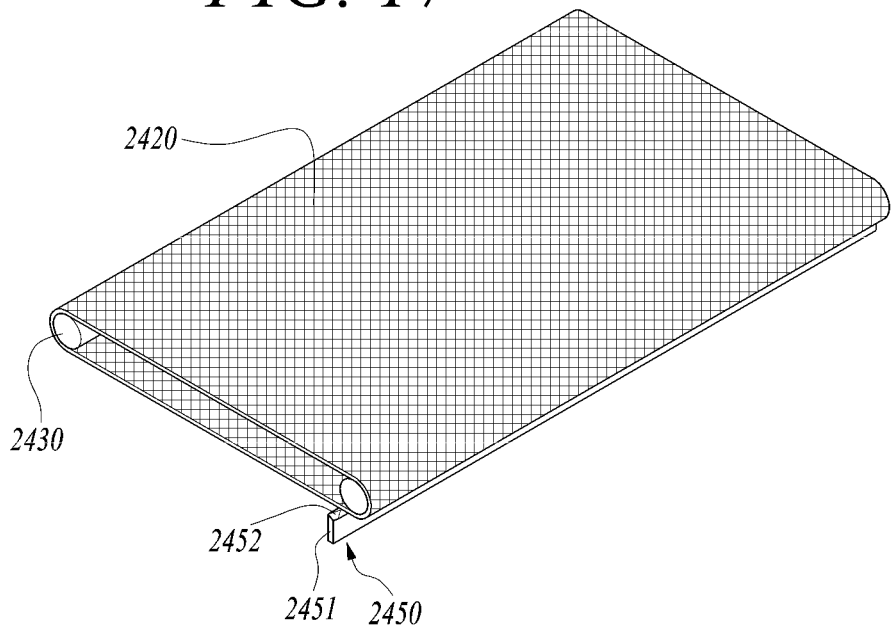
FIG. 17 is a perspective view illustrating an adsorption belt and rollers according to the second exemplary embodiment.

FIG. 16 is a cross-sectional view illustrating a washing water treatment device 2400 disposed in the lower portion of the dust collecting tower apparatus 1000 according to the second exemplary embodiment. FIG. 17 is a perspective view illustrating an adsorption belt 2420 and rollers 2430 according to the second exemplary embodiment.

Referring to FIGS. 16 and 17, since the dust collecting tower apparatus 1000 according to the second exemplary embodiment has the same structure as the dust collecting tower apparatus 1000 according to the first exemplary embodiment, except for the washing water treatment device 2400, a redundant description thereof will be omitted.

The washing water treatment device 2400 is disposed in the lower portion of a housing 2200. The washing water treatment device 2400 accommodates washing water dropping from the collection module 100 and solidifies dust contained in the washing water. The washing water treatment device 2400 includes a reservoir 2410 configured to store washing water, the adsorption belt 2420 installed at the upper portion of the reservoir 2410, the rollers 2430 configured to move the adsorption belt 2420, and a scraper 2450 configured to separate the dust attached on the adsorption belt 2420. Here, the washing water may be water or an aqueous sodium hydroxide solution. When the aqueous sodium hydroxide solution is used as the washing water, the washing capability of the washing water treatment device can be improved.

The reservoir 2410 is disposed on the bottom of the housing 2200 and stores the washing water supplied through a washing water feeder therein. The reservoir 2410 may be connected to a washing water replenishment line 2460 for replenishment of washing water, and the washing water replenishment line 2460 may have a valve installed therein.

The adsorption belt 2420 may be in a mesh form, and be made of porous metal or synthetic resin. When the adsorption belt 2420 is in the mesh form, the dust contained in the washing water may be attached on the adsorption belt 2420 and the washing water may flow into the reservoir through the adsorption belt 2420.

The adsorption belt 2420 is in an endless-track form that its longitudinal ends are connected to each other. The lower portion of the adsorption belt 2420 is submerged in the washing water and the upper portion of the adsorption belt 2420 is positioned above the washing water for exposure out of the washing water. That is, in the annular adsorption belt 2420 that is flat in longitudinal section, its lower vertical center may be submerged in the washing water and its upper vertical center may be positioned above the washing water. The adsorption belt 2420 has a flat upper surface positioned above the washing water, a flat lower surface submerged in the washing water, and curved side surfaces connecting the upper surface and the lower surface.

During the operation of the adsorption belt 2420, the lower portion of the adsorption belt 2420 adsorbs the dust in the washing water and the upper portion thereof adsorbs the dust contained in the dropping washing water.

The two rollers 2430 support both longitudinal ends of the adsorption belt 2420. A motor for rotating the rollers 2430 is connected to the rollers 2430 to move the adsorption belt 2420. The rollers 2430 may be intermittently operated when washing water is supplied.

The scraper 2450 abuts on the lower portion of the adsorption belt 2420 to scrape off the dust attached on the adsorption belt 2420 to separate the dust from the adsorption belt 2420. The scraper 2450 includes a support rod 2451 and a tip 2452 fixed on the support rod 2451. The support rod 2451 is installed vertically and fixedly on the bottom of the reservoir 2410. The tip 2452 may be inclined relative to the support rod 2451 while protruding upward, and be made of an elastic material. The mass of dust separated by the scraper 2450 is solidified and accumulated on the bottom of the reservoir 2410 so that relatively clean washing water is present at the upper portion of the reservoir 2410. Such upper washing water may be supplied to the washing water feeder for use for further washing.

Thus, according to the second exemplary embodiment, the washing water stored in the reservoir 2410 can be used for a predetermined period without being discharged. In addition, when the washing water needs to be replaced, a worker can remove the mass of dust from the bottom of the reservoir 2410 and replace the washing water.

As described above, according to the second exemplary embodiment, since the mass of dust sinks to the bottom of the reservoir 2410, it may be possible to purify the washing water and thus increase the service life of the washing water.

Hereinafter, a dust collecting tower apparatus according to a third exemplary embodiment will be described.

Figure 18:
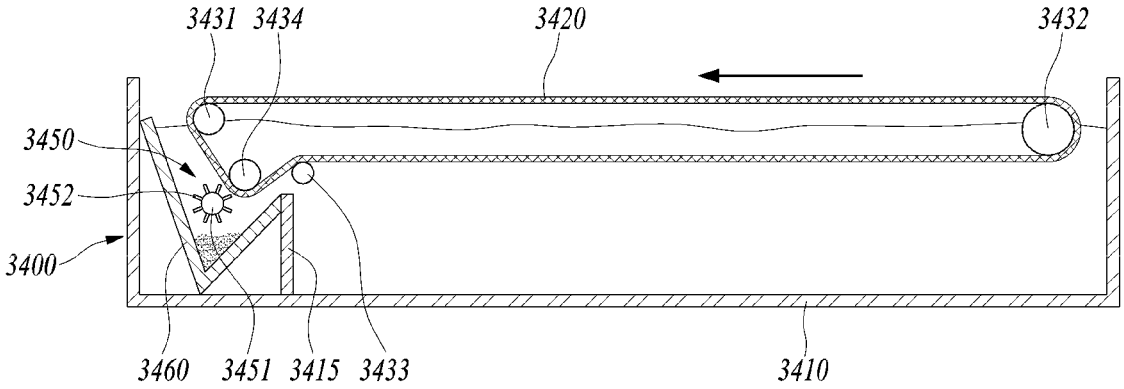
FIG. 18 is a cross-sectional view illustrating a washing water treatment device disposed in a lower portion of a dust collecting tower apparatus according to a third exemplary embodiment.

FIG. 18 is a cross-sectional view illustrating a washing water treatment device 3400 disposed in the lower portion of the dust collecting tower apparatus according to the third exemplary embodiment.

Referring to FIG. 18, since the dust collecting tower apparatus according to the third exemplary embodiment has the same structure as the dust collecting tower apparatus according to the first exemplary embodiment, except for the washing water treatment device 3400, a redundant description thereof will be omitted.

The washing water treatment device 3400 is disposed in the lower portion of a housing. The washing water treatment device 3400 accommodates washing water dropping from the collection module 100 and solidifies dust contained in the washing water. The washing water treatment device 3400 includes a reservoir 3410 configured to store washing water, an adsorption belt 3420 installed at the upper portion of the reservoir 3410, rollers configured to move the adsorption belt 3420, and a scraper 3450 configured to separate the dust attached on the adsorption belt 3420. Here, the washing water may be water or an aqueous sodium hydroxide solution. When the aqueous sodium hydroxide solution is used as the washing water, the washing capability of the washing water treatment device can be improved.

The reservoir 3410 is disposed on the bottom of the housing and stores the washing water supplied through a washing water feeder therein. The reservoir 3410 may be connected to a washing water replenishment line for replenishment of washing water, and the washing water replenishment line may have a valve installed therein.

The adsorption belt 3420 may be in a mesh form, and be made of porous metal or synthetic resin. When the adsorption belt 3420 is in the mesh form, the dust contained in the washing water may be attached on the adsorption belt 3420 and the washing water may flow into the reservoir 3410 through the adsorption belt 3420.

That is, the adsorption belt 3420 may be formed of a metal or synthetic resin mesh as a net structure that warps and wefts are entangled. In addition, a plurality of fine protrusions for adsorption of dust may be formed on a wire forming the adsorption belt 3420. Here, the fine protrusions refer to protrusions having a diameter smaller than 0.1 mm. On the other hand, the adsorption belt 3420 may be formed of a porous metal or synthetic resin plate. When the adsorption belt 3420 is in the mesh form, the dust contained in the washing water may be attached on the adsorption belt 3420 and the washing water may flow into the reservoir 3410 through the adsorption belt 3420.

The adsorption belt 3420 is in an endless-track form that its longitudinal ends are connected to each other. The lower portion of the adsorption belt 3420 is submerged in the washing water and the upper portion of the adsorption belt 3420 is positioned above the washing water for exposure out of the washing water. During the operation of the adsorption belt 3420, the lower portion of the adsorption belt 3420 adsorbs the dust in the washing water and the upper portion thereof adsorbs the dust contained in the dropping washing water. The dust may be adsorbed onto the exposed portion of the adsorption belt 3420 and move to the scraper 3450.

The rollers are installed to the adsorption belt 3420 to support and move the adsorption belt 3420. The rollers include two support rollers 3431 and 3432 positioned at both longitudinal ends of the adsorption belt 3420, and first and second diversion rollers 3433 and 3434 are disposed between the support rollers 3431 and 3432 to support the lower portion of the adsorption belt 3420, which is bent vertically. The support rollers 3431 and 3432 abut on the inward surface of the adsorption belt 3420, the first diversion roller 3433 abuts on the outer surface of the adsorption belt 3420, and the second diversion roller 3434 abuts on the outward surface of the adsorption belt 3420.

The first diversion roller 3433 supports the lower end of the adsorption belt 3420 to move upward so that the lower end of the adsorption belt 3420 is inclined relative to the ground. The vertical distance between the upper and lower portions of the adsorption belts 3420 decreases from the support roller 3432 to the first diversion roller 3433. The second diversion roller 3434 is disposed between the first diversion roller 3433 and the support roller 3431 to support the lower end of the adsorption belt 3420, which is inclined upward.

The second diversion roller 3434 allows the lower end of the adsorption belt 3420 to be positioned beneath the upper end of a blocking wall 3415. That is, the first diversion roller 3433 supports the adsorption belt 3420 to move above the upper end of the blocking wall 3415, thereby preventing the adsorption belt 3420 from interfering with the blocking wall 3415. The second diversion roller 3434 allows the lower end of the adsorption belt 3420 to be positioned beneath the blocking wall 3415, thereby preventing a mass of dust from crossing the blocking wall 3415. The scraper 3450 abuts on the adsorption belt 3420 between the second diversion roller 3434 and the support roller 3431.

The blocking wall 3415 is installed in the reservoir 3410 and separates the space, in which the scraper 3450 is present, from the remaining space. The blocking wall 3415 may be positioned between the first diversion roller 3433 and the second diversion roller 3434, but the present disclosure is not limited thereto. However, the blocking wall 3415 may be disposed adjacent to the scraper 3450. The first diversion roller 3433 may be positioned above the blocking wall 3415.

The scraper 3450 is installed in the reservoir and abuts on the lower portion of the adsorption belt 3420 to scrape off the dust attached on the adsorption belt 3420 and to separate the dust from the adsorption belt 3420. The scraper 3450 includes a rotational column 3451 and a plurality of separation ribs 3452 protruding from the outer peripheral surface of the column 3451. The separation ribs 3452 may be plates extending in the longitudinal direction of the column 3451 and be spaced apart from each other in the circumferential direction of the column 3451. The separation ribs 3452 may each be made of an elastic material and abut on the adsorption belt 3420 to scrape off dust. A motor may be connected to the column 3451 to rotate the column 3451.

The mass of dust separated by the scraper 3450 is solidified and accumulated on the bottom of the reservoir 3410 so that relatively clean washing water is present at the upper portion of the reservoir 3410. Since the mass of dust is placed in the space separated by the blocking wall 3415, the washing water in the remaining space can be purified.

Meanwhile, a separation container 3460 may be installed beneath the scraper 3450 to accommodate a mass of dust. The separation container 3460 may be positioned in the space separated by the blocking wall 3415, and have a triangular longitudinal section. Thus, the mass of dust in the separation container 3460 cannot be easily separated from the separation container, and the worker can easily manage the washing water by periodically replacing the separation container.

According to the third exemplary embodiment, the washing water stored in the reservoir 3410 can be used for a predetermined period without being discharged. In addition, when the washing water needs to be replaced, a worker can remove the mass of dust from the bottom of the reservoir 3410 and replace the washing water.

As described above, according to the third exemplary embodiment, since the mass of dust sinks to the bottom of the reservoir 3410, it may be possible to purify the washing water and thus increase the service life of the washing water.

Figure 19:
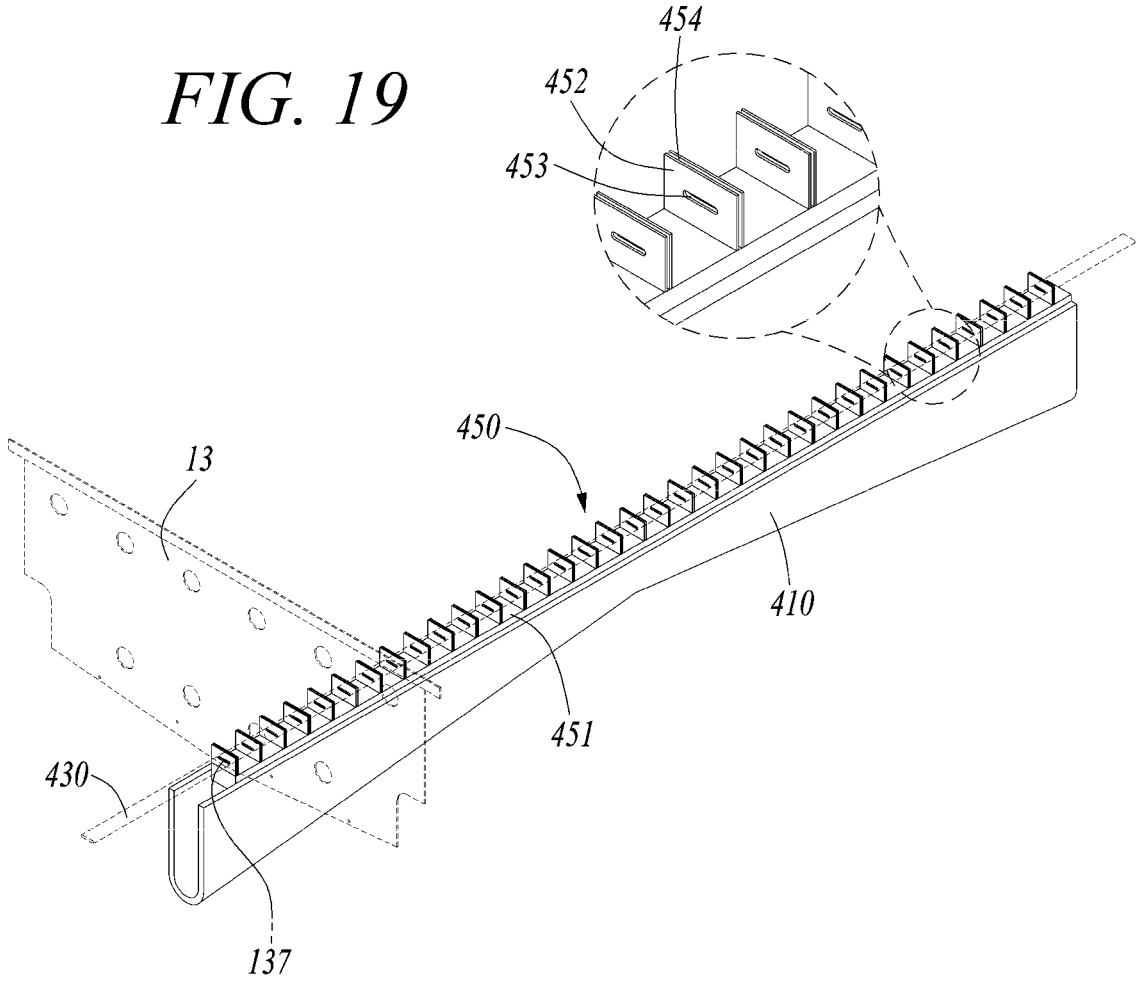
FIG. 19 is a perspective view illustrating a support hanger and a discharge guide in a dust collecting tower apparatus according to a fourth exemplary embodiment.

Hereinafter, a dust collecting tower apparatus according to a fourth exemplary embodiment will be described. FIG. 19 is a perspective view illustrating a support hanger 450 and a discharge guide 410 in the dust collecting tower apparatus according to the fourth exemplary embodiment Referring to FIG. 19, since the dust collecting tower apparatus according to the fourth exemplary embodiment has the same structure as the dust collecting tower apparatus according to the first exemplary embodiment, except that the support hanger 450 and the discharge guide 410 are installed in the collection module 100, a redundant description thereof will be omitted.

The support hanger 450 and the discharge guide 410 are installed beneath the collection module 100 to collect the contaminated washing water discharged from collection electrodes 13. The collection electrodes 13 have fixing holes 137 formed at the respective centers thereof, and a hanger fixing rod 430 extending in the stacking direction of the collection electrodes 13 is inserted into the fixing holes 137. The hanger fixing rod 430 is coupled to the support hanger 450 to fix the support hanger 450 to the collection electrodes 13.

The support hanger 450 includes a lower support rod 451 extending in the stacking direction of the collection electrodes 13, and connection protrusions 452 protruding upward from the lower support rod 451 so that the lower ends of the collection electrodes 13 are respectively fitted to the connection protrusions 452. Each of the connection protrusions 452 has a connection groove 454 into which the lower end of the associated collection electrode 13 is inserted, and the connection groove 454 is formed with a support hole 453 into which the hanger fixing rod 430 is inserted.

The connection protrusion 452 may be formed of two plates spaced apart from each other, and the connection groove 454 may be formed between the plates. The connection protrusions 452 are spaced apart from each other in the longitudinal direction of the lower support rod 451 and coupled to the lower ends of the respective collection electrodes 13. Each of the support hole 453 is connected to the associated fixing hole 137 so that the hanger fixing rod 430 is installed through the support hole 453 and the fixing hole 137. Thus, the support hanger 450 may be stably fixed to the lower ends of the collection electrodes 13.

The discharge guide 410 is disposed at the widthwise centers of the collection electrodes 13, and has a width smaller than one collection electrode 13. For example, the width of the discharge guide 410 may be 1/100 to 1/10 of that of the collection electrode 13.

The discharge guide 410 is open at the upper side thereof and has a channel defined therein so that washing water flows through the channel. The discharge guide 410 may be configured such that the bottom of the center thereof is higher than the bottoms of both sides thereof and the bottom thereof is gradually lowered from center to both sides.

Thus, the washing water introduced into the discharge guide 410 may flow to both longitudinal sides of the discharge guide 410. Drain pipes (not illustrated) for discharge of washing water may be connected to both side ends of the discharge guide 410.

The collection electrode 13 is inclined at the lower end thereof so that the central portion of the collection electrode 13 protrudes downward. Thus, the washing water flowing along the surface of the collection electrode 13 is collected at the lowest end of the central portion of the collection electrode 13 along the lower end of the collection electrode 13. The washing water concentrated on the lower end of the central portion of the collection electrode 13 may flow into the discharge guide 410 and be discharged to the outside.

As described above, according to the fourth exemplary embodiment, since the support hanger 450 and the discharge guide 410 are installed beneath the collection electrodes 13, it may be possible to stably discharge the washing water while minimally interrupting the flow of gas and to prevent the washing water containing impurities from contaminating cooling water.

Figure 20:
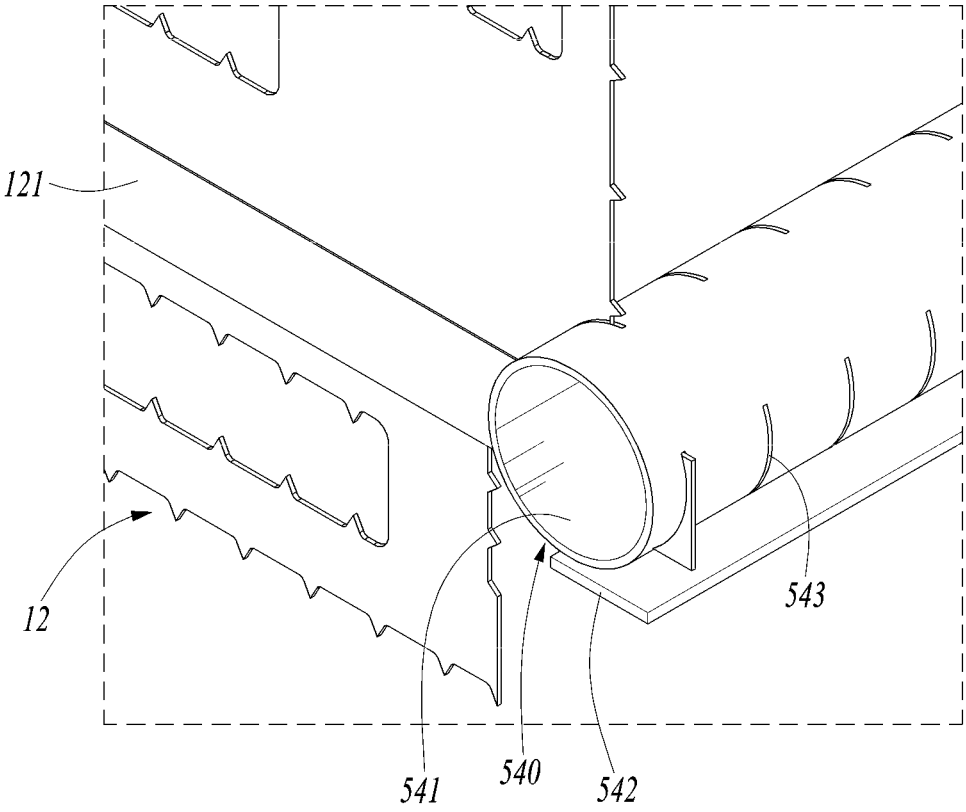
FIG. 20 is a perspective view partially illustrating one first setting beam and one discharge electrode according to a fifth exemplary embodiment.

Hereinafter, a collection module according to a fifth exemplary embodiment will be described. FIG. 20 is a perspective view partially illustrating a first setting beam 540 and the discharge electrode 12 according to the fifth exemplary embodiment.

Referring to FIG. 20, since the collection module according to the fifth exemplary embodiment has the same structure as that of the dust collecting tower apparatus according to the first exemplary embodiment, except for the first setting beam, a redundant description thereof will be omitted.

The first setting beam 540 extends in the stacking direction of the discharge electrodes 12, and has a plurality of lower slots 543 into which the side ends of the respective discharge electrodes 12 are inserted. The first reinforcement rod 121 of each discharge electrode 12 is inserted into the first setting beam 540. The first reinforcement rod 121 is installed to pass through the first setting beam 540, and the lower end of the first reinforcement rod 121 is supported by the first setting beam 540.

The first setting beam 540 includes a tubular support pipe 541 having a circular cross-section and a lower support plate 542 fixed to the lower end of the support pipe 541. The support pipe 541 has the plurality of lower slots 543 into which the first reinforcement rods 121 and side ends of the respective discharge electrodes 12 are inserted.

Meanwhile, the lower support plate 542 has a flat plate shape and is fixedly installed to the lower end of the support pipe 541. The lower support plate 542 abuts on the lower surfaces of the first reinforcement rods 121 to support the first reinforcement rods 121.

As described above, according to the fifth exemplary embodiment, it may be possible to more easily couple the first setting beam 540 to the discharge electrodes 12.

Figure 21:
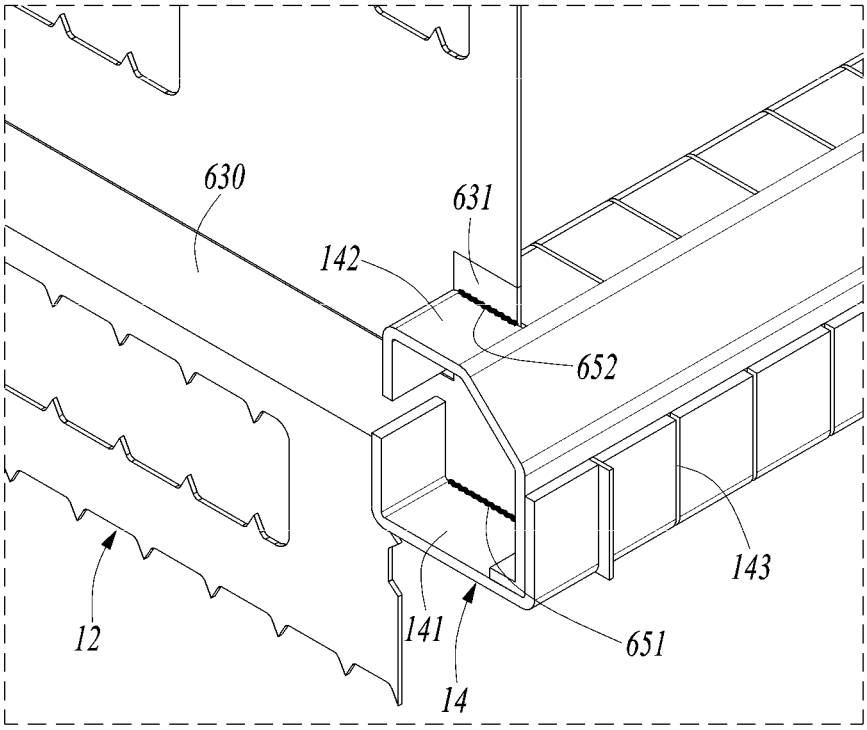
FIG. 21 is a perspective view partially illustrating one first setting beam and one discharge electrode according to a sixth exemplary embodiment.

Hereinafter, a collection module according to a sixth exemplary embodiment will be described. FIG. 21 is a perspective view partially illustrating the first setting beam 14 and the discharge electrode 12 according to the sixth exemplary embodiment.

Referring to FIG. 21, since the collection module according to the sixth exemplary embodiment has the same structure as the collection module according to the first exemplary embodiment, except for a structure of a first reinforcement rod 630, a redundant description thereof will be omitted.

The discharge electrode 12 includes the first reinforcement rod 630 installed at the lower portion thereof, and the first reinforcement rod 630 is coupled to the first setting beams 14 to support the discharge electrode 12. The first reinforcement rod 630 is longer than the width of the discharge electrode 12 so as to protrude from both side ends of the discharge electrode 12. The first reinforcement rod 630 may be bonded to the first setting beam 14 through a first welding portion 651.

The first reinforcement rod 630 has a support protrusion 631 protruding upward. The support protrusion 631 may pass through the upper end of the first setting beam 14 and may be bonded to the first setting beam 14 by welding. Thus, the support protrusion 631 is bonded to the first setting beam 14 through a second welding portion 652.

The first setting beam 14 extends in the stacking direction of the discharge electrodes 12, and has a plurality of lower slots 143 into which the side ends of the respective discharge electrodes 12 are inserted. The first reinforcement rod 630 is inserted into the first setting beam 14. The first reinforcement rod 630 is installed to pass through the first setting beam 14, and the lower end of the first reinforcement rod 630 is supported by the first setting beam 14.

The first setting beam 14 includes a lower beam 141 and an upper beam 142 coupled to the lower beam 141. The first welding portion 651 fixes a portion of the first reinforcement rod 630, which extends in the longitudinal direction of the discharge electrode, to the lower beam 141, and the second welding portion 652 fixes the support protrusion 631 to the upper beam 142.

As described above, according to the sixth exemplary embodiment, since the support protrusion 631 is formed on the first reinforcement rod 630 and the first reinforcement rod 630 is fixed by the first setting beam 14 and the first and second welding portions 651 and 652, the discharge electrode 12 can be fixed more stably.

As is apparent from the above description, since the dust collecting tower apparatus according to the exemplary embodiments includes the collection module installed therein, it is possible to effectively remove the dust contained in the air while minimizing the differential pressure.

While the specific embodiments have been described with reference to the drawings, the disclosure is not limited thereto. It will be apparent to those skilled in the art that various changes and modifications may be made without departing from the spirit and scope of the disclosure as defined in the following claims.

What is claimed is:

1. A dust collecting tower apparatus for collecting fine dust contained in air, the apparatus comprising:

a housing having an inlet into which gas is introduced, and an outlet from which the gas is discharged;

a collection module disposed in the housing and configured to collect particulates with a corona discharge, the collection module comprising:

a plurality of discharge electrodes to which voltage is applied, a plurality of collection electrodes disposed between the plurality of discharge electrodes, and wherein the plurality of collection electrodes are coupled to ground, and a setting beam having a plurality of slots into which the plurality of discharge electrodes are inserted;

a washing water feeder configured to spray washing water to the collection module; and a washing water treatment device disposed beneath the collection module to accommodate the washing water dropping from the collection module, wherein the washing water treatment device comprises;

a reservoir configured to accommodate the washing water;

an adsorption belt in an endless-track form;

a roller connected to the adsorption belt to move the adsorption belt; and a scraper configured to scrape off dust attached on the adsorption belt to separate the scraped dust from the absorption belt.

2. The dust collecting tower apparatus according to claim 1, wherein a solar panel is attached to an outer surface of the housing to produce electricity with light.

3. The dust collecting tower apparatus according to claim 1, wherein a display panel is attached to an outer surface of the housing to display an atmospheric state.

4. The dust collecting tower apparatus according to claim 1, wherein the adsorption belt is in a mesh form.

5. The dust collecting tower apparatus according to claim 1, wherein a portion of the adsorption belt is submerged in the washing water and another portion of the adsorption belt is positioned above the washing water.

6. The dust collecting tower apparatus according to claim 1, wherein the scraper comprises a support rod installed vertically on the bottom of the reservoir and an elastic tip protruding upward from the support rod.

7. The dust collecting tower apparatus according to claim 1, wherein the scraper comprises a rotational column and a plurality of separation ribs protruding from an outer peripheral surface of the rotational column, the plurality of separation ribs being spaced apart from each other in a circumferential direction of the rotational column.

8. The dust collecting tower apparatus according to claim 1, wherein:

the washing water treatment device comprises two support rollers and first and second diversion rollers disposed between the support rollers, the first diversion roller being configured to support an end of the adsorption belt to move upward, the second division roller being configured to support the end of the adsorption belt to move downward;

a blocking wall is installed in the reservoir to separate a space, in which the scraper is present, from a remaining space; and the first diversion roller supports the adsorption belt to be positioned above a top end of the blocking wall, and the second diversion roller supports the adsorption belt to be positioned beneath the top end of the blocking wall.

9. The dust collecting tower apparatus according to claim 8, wherein the scraper abuts on the adsorption belt between the second diversion roller and an associated one of the support rollers.

10. The dust collecting tower apparatus according to claim 8, wherein a separation container is installed beneath the scraper and positioned in the space separated by the blocking wall.

11. The dust collecting tower apparatus according to claim 1, further comprising a frame assembly fixed in the housing to support the collection module, wherein the frame assembly comprises a frame extending in a stacking direction of the plurality of discharge electrodes to support the setting beam, the frame being configured to apply a voltage to the plurality of discharge electrodes through the setting beam.

12. A dust collecting tower apparatus for collecting fine dust contained in air, the apparatus comprising:

a housing having an inlet into which gas is introduced, and an outlet from which the gas is discharge;

a collection module disposed in the housing and configured to collect particulates with a corona discharge, the collection module comprising;

a plurality of discharge electrodes to which voltage applied, a plurality of collectin electrodes disposed between the plurality of discharge electrodes, and wherein the plurality of collection electrodes are coupled to ground, and a setting beam having a plurality slots into which the plurality of discharge electrodes are inserted;

a washing water feeder configured to spray washing water to the collection module; and a frame assembly fixed in the housing to support the collection module, wherein the frame assembly comprises a prestress locking member fixed in the housing in a state in which a pressing force is applied to the collection module.

13. The dust collecting tower apparatus according to claim 12, wherein the prestress locking member comprises a casing, an insulator installed in the casing, a pressure rod coupled to the insulator while protruding downward, and a pressing support fixed to the pressure rod to press the collection module.

14. The dust collecting tower apparatus according to claim 12, wherein:

the collection module comprises first tie rods fixed to the plurality of discharge electrodes and installed to pass through the plurality of collection electrodes, second tie rods fixed to the plurality of collection electrodes and installed to pass through the discharge electrodes, and a plurality of support beams to which some of the first tie rods are fixed; and the prestress locking member is fixedly installed to press an associated one of the support beams inward.

15. A dust collecting tower apparatus for collecting fine dust contained in air, the apparatus comprising:

a housing having an inlet into which gas is introduced, and an outlet from which the gas is discharges;

a collection module disposed in the housing and configured to collect particulates with a corona discharge, the collection module comprising:

a plurality of discharge electrodes to which voltage is applied, a plurality of collection electrodes disposed between the plurality of discharge electrodes, and wherein the plurality of collection electrodes are coupled to ground, and a setting beam having a plurality of slots into which the plurality of discharge electrodes are inserted;

a washing water feeder configured to spray washing water to the collection module, wherein:

the plurality of collection electrodes have lowest ends formed on respective bottom surfaces thereof so that the washing water is concentrated on the lowest ends, and a discharge guide is installed immediately beneath the lowest ends and has a channel in which the washing water flowing down from the plurality of collection electrodes is accommodated; and the discharge guide extends in a stacking direction of the plurality of collection electrodes.

16. The dust collecting tower apparatus according to claim 15, wherein:

the plurality of collection electrodes have fixing holes formed in respective portions thereof, and a hanger fixing rod is inserted into the fixing holes; and the hanger fixing rod is coupled to a support hanger that supports the discharge guide, the support hanger comprises a plurality of connection protrusions protruding upward and inserted into the respective portions of the plurality of collection electrodes, and the plurality of connection protrusions are respectively formed with support holes into which the hanger fixing rod is inserted.

* * * * *